US008388121B2

(12) United States Patent
Tamada et al.

(10) Patent No.: US 8,388,121 B2
(45) Date of Patent: Mar. 5, 2013

(54) LIQUID-JETTING APPARATUS

(75) Inventors: Hisashi Tamada, Nagoya (JP); Keiji Kura, Nagoya (JP); Yusuke Suzuki, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 372 days.

(21) Appl. No.: 12/871,322

(22) Filed: Aug. 30, 2010

(65) Prior Publication Data

US 2011/0050817 A1 Mar. 3, 2011

(30) Foreign Application Priority Data

Aug. 31, 2009 (JP) ..... 2009-199395

(51) Int. Cl.
*B41J 2/175* (2006.01)

(52) U.S. Cl. ..... 347/85; 347/84

(58) Field of Classification Search ..... 347/84, 347/85, 86, 87; 141/2, 18
See application file for complete search history.

(56) References Cited

U.S. PATENT DOCUMENTS 4,680,696 A * 7/1987 Ebinuma et al. ..... 347/85
5,943,078 A * 8/1999 Nishimoto et al. ..... 347/89
7,347,540 B2 * 3/2008 Piock et al. ..... 347/85
7,901,063 B2 * 3/2011 Wouters et al. ..... 347/89
8,002,395 B2 * 8/2011 Langford et al. ..... 347/85
2009/0058956 A1 3/2009 Davis et al.

FOREIGN PATENT DOCUMENTS

JP 8-276604 10/1996
JP 2006-199040 8/2006
JP 2008-238750 10/2008

* cited by examiner

*Primary Examiner* — Anh T. N. Vo

(74) *Attorney, Agent, or Firm* — Scully, Scott, Murphy & Presser PC

(57) ABSTRACT

A liquid-jetting apparatus includes: a liquid-jetting head which jets the liquid; a liquid tank which stores the liquid; a first flow passage which connects the liquid-jetting head and the liquid tank; a gas-liquid separating section which is arranged on the first flow passage and which separates the liquid and a gas in the liquid; a gas communication passage which connects the gas-liquid separating section and the liquid tank and through which the gas in the gas-liquid separating section is transported to the liquid tank; a second flow passage which communicates an upstream side and a down stream side of the gas-liquid separating section; and a switching mechanism which selectively switches between a first passage route for supplying the liquid through only the first flow passage and a second passage route for supplying the liquid through the second flow passage.

13 Claims, 7 Drawing Sheets

LIQUID-JETTING APPARATUS

CROSS REFERENCE TO RELATED APPLICATION

The present application claims priority from Japanese Patent Application No. 2009-199395 filed on Aug. 31, 2009, the disclosures of which are incorporated herein by reference in their entirety.

BACKGROUND OF THE INVENTION

1. Field of the Invention

The present invention relates to a liquid-jetting apparatus which jets a liquid.

2. Description of the Related Art

A liquid jetting apparatus, in which a liquid supplied from a liquid tank is jetted from a liquid-jetting head, has been hitherto known. The gas is sometimes mixed from the outside on account of various reasons into the liquid flow passage of such a liquid-jetting apparatus ranging from the liquid tank to the liquid-jetting head.

In general, for example, a cartridge, which stores an ink, is detachably attached to an ink-jet printer provided with an ink-jet head for recording a desired image and/or letters by jetting the ink onto a recording medium. The ink, which is supplied from the cartridge, is jetted from the ink-jet head. In the case of the ink-jet printer as described above, the gas is sometimes mixed from the outside via a joining portion between the cartridge and an attachment section for attaching the cartridge, due to any factor including, for example, the exchange of the cartridge. The gas, which is dissolved in the ink, is sometimes converted into bubbles due to the change of the temperature and/or the pressure. If the gas flows to the ink-jet head together with the ink, for example, there is such a possibility that the jetting failure and/or the flow passage clog-up may be caused.

In view of the above, in order to discharge the gas in the ink-jet head, for example, the following arrangement is conceived by utilizing an arrangement adopted for a printer as described in US 2009/0058956 (corresponding to Japanese Patent Application Laid-open No. 2006-199040). That is, a pump is provided at an intermediate position of a flow passage which connects an ink-jet head and a cartridge. The gas is extracted or drawn out together with the ink in the ink-jet head in accordance with the suction driving effected by the pump. After that, the pump is driven in the direction opposite to the direction adopted during the suction driving to extrude or push out only the ink from the cartridge to the ink-jet head.

However, the printer, which is described in US 2009/0058956, requires the pump which is the exclusive sucking means in order to discharge the gas mixed into the ink in the ink-jet head.

SUMMARY OF THE INVENTION

An object of the present invention is to provide a liquid jetting apparatus which makes it possible to easily discharge the gas mixed into a supply route for a liquid ranging from a liquid tank to a liquid-jetting head without adding any sucking means such as a pump or the like.

According to a first aspect of the present invention, there is provided a liquid-jetting apparatus which jets a liquid, the liquid-jetting apparatus including: a liquid-jetting head which jets the liquid; a liquid tank which stores the liquid to be supplied to the liquid-jetting head; a first flow passage which connects the liquid-jetting head and the liquid tank; a gas-liquid separating section which is arranged at an intermediate position of the first flow passage and which separates the liquid and a gas existing in the liquid from each other; a gas communication passage which connects the gas-liquid separating section and the liquid tank and through which the gas in the gas-liquid separating section is transported to the liquid tank; a valve which is arranged at an intermediate position of the gas communication passage and which avoids inflow of the gas from the liquid tank to the gas-liquid separating section; a second flow passage which communicates an upstream side of the gas-liquid separating section and a downstream side of the gas-liquid separating section without passing through the gas-liquid separating section; and a switching mechanism which selectively switches between a first passage route for supplying the liquid in the liquid tank to the liquid-jetting head through only the first flow passage and a second passage route for supplying the liquid in the liquid tank to the liquid-jetting head through the second flow passage without passing through the gas-liquid separating section.

According to the liquid-jetting apparatus of the present invention, when the liquid is consumed from the liquid-jetting head while switching the second passage route to open by the switching mechanism, the liquid in the liquid tank is consumed and decreased via the second flow passage which does not pass through the gas-liquid separating section. Accordingly, the pressure in the liquid tank becomes lower than the pressure in the gas-liquid separating section, and the gas flows into the liquid tank having the low pressure via the gas communication passage from the gas-liquid separating section having the high pressure. Accordingly, the gas in the gas-liquid separating section can be transported to the liquid tank, and it is possible to avoid inflow of the gas into the liquid jetting head. In this way, the gas, which is mixed into the liquid supply route ranging from the liquid tank to the liquid-jetting head, can be easily discharged without adding any exclusive sucking means such as a pump or the like. Further, when the liquid is consumed from the liquid-jetting head, for example, during the ordinary jetting in which the liquid is jetted from the liquid-jetting head toward the jetting objective for landing the jetted liquid thereon or during the purge in which the liquid is sucked and discharged from the liquid-jetting head, the gas in the gas-liquid separating section can be simultaneously transported to the liquid tank by merely switching the second passage route to open. In the present invention, the liquid is supplied from the liquid tank to the liquid jetting head. Therefore, the liquid tank is regarded as the upstream end, and the liquid-jetting head is regarded as the downstream end.

DESCRIPTION OF THE PREFERRED EMBODIMENTS

Next, an embodiment of the present invention will be explained. In this embodiment, the present invention is applied to a printer by which, for example, a desired image and/or letters is/are recorded (printed) on the recording paper by jetting inks from an ink-jet head to the recording paper.

Figure 1:
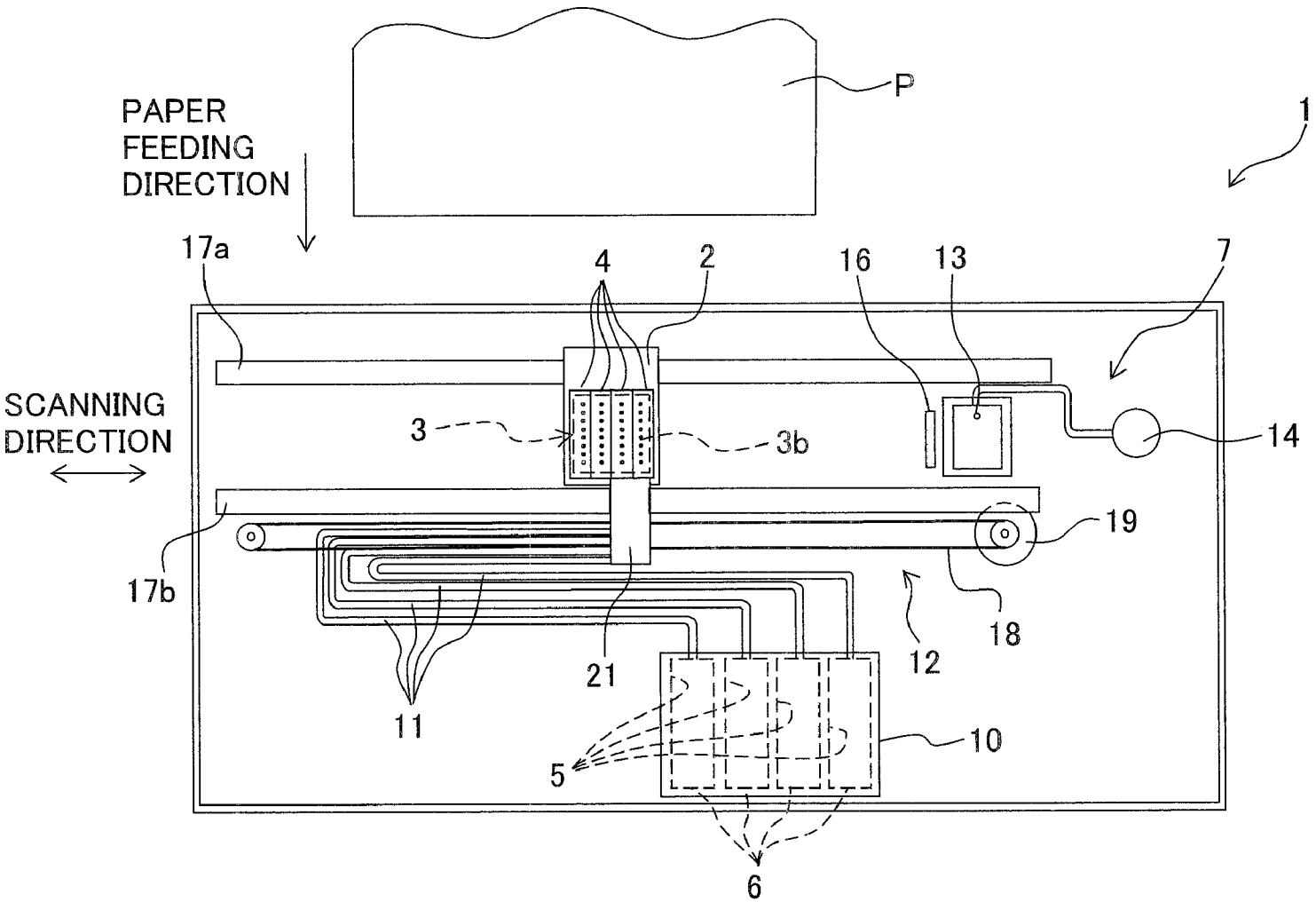
FIG. 1 shows a plan view illustrating a printer according to an embodiment of the present invention.

At first, an explanation will be made with reference to FIG. 1 about a schematic arrangement of the printer 1. As shown in FIG. 1, the printer 1 (liquid-jetting apparatus) includes a carriage 2 which is constructed to be reciprocatively movable in one direction, an ink-jet head 3 (liquid-jetting head) which is carried on the carriage 2, and subtanks 4 (gas-liquid separating sections). The printer 1 further includes ink cartridges 6 (liquid tanks) which store the inks, a holder 10 to which the ink cartridges 6 are detachably attached, and a maintenance mechanism 7 which restores the performance of the ink-jet head 3 when the liquid-jetting performance of the ink-jet head 3 is deteriorated, for example, due to the increase in ink viscosity and/or the mixing of the gas into the ink-jet head 3. The printer 1 further includes a control unit 8 (controller) (see FIG. 3) which controls the respective components of the printer 1.

The printer 1 is provided with two guide frames 17*a*, 17*b* which extend in parallel to the horizontal one direction (left-right direction as viewed in FIG. 1: scanning direction) and which are arranged while providing a spacing distance in the paper feeding direction perpendicular to the scanning direction. The carriage 2 is attached to the two guide frames 17*a*, 17*b*. The carriage 2 is reciprocatively driven in the scanning direction by a carriage driving mechanism 12 while being guided by the two guide frames 17*a*, 17*b*. The carriage driving mechanism 12 includes an endless belt 18 which is connected or joined to the carriage 2, and a carriage driving motor 19 which allows the endless belt 18 to run or travel. When the endless belt 18 is driven to travel by the carriage driving motor 19, the carriage 2 is reciprocatively moved in the scanning direction in accordance with the travel of the endless belt 18.

The ink-jet head 3 and the four subtanks 4 are carried on the carriage 2. The four subtanks 4 are arranged and aligned in the scanning direction. The ink-jet head 3 is provided under or below the four subtanks 4. The subtanks 4 temporarily store the inks supplied from the ink cartridges 6 so that the gas does not flow into the ink-jet head 3. The subtanks 4 separate the gas which is flowed together with the inks from the inks which are supplied from the ink cartridges 6, and the subtanks 4 supply only the inks to the ink-jet head 3. Further, the subtanks 4 also function as buffer tanks which dissolve the supply shortage of the inks to be supplied to the ink-jet head 3.

A tube joint 21 is integrally provided at one end portion of each of the four subtanks 4. The four subtanks 4 are connected respectively to the four ink cartridges 6 attached to cartridge attachment sections 5 of the holder 10, via four flexible tubes 11 connected to the tube joint 21. For example, the four color inks of black, yellow, cyan, and magenta are stored respectively in the four ink cartridges 6. The ink cartridges 6 are detachably attached to the cartridge attachment sections 5 of the holder 10. On the other hand, the other end portion of each of the four subtanks 4 is connected to an ink supply port (not shown) provided on the upper surface of the ink-jet head 3 for each of the ink colors. Accordingly, the four color inks, which are supplied from the four ink cartridges 6 via the four tubes 11, are temporarily stored in the four subtanks 4 respectively, and then the inks are supplied to the ink-jet head 3.

When the carriage 2 is reciprocatively moved in the scanning direction, the dynamic pressure arises in the ink in the tube 11 by being affected by the acceleration brought about during the movement. When the dynamic pressure is transmitted to the ink in the ink-jet head 3, the jetting characteristic becomes unstable, for example, such that the jetting velocity is changed. The subtank 4 of this embodiment has a relatively large volume as compared with the volume in the tube 11, and the subtank 4 is reciprocatively movable together with the ink-jet head 3. Therefore, the dynamic pressure is absorbed by the internal gas, and the dynamic pressure is not transmitted to the ink in the ink-jet head 3.

The ink-jet head 3 has, on its lower surface, a liquid jetting surface 3*a* on which a large number of nozzles 3*b* are open. The ink-jet head 3 jets the inks supplied from the subtanks 4, from the plurality of nozzles 3*b* respectively toward the recording paper P transported in the paper feeding direction (downward direction as viewed in FIG. 1) by means of a transport mechanism 9 (see FIG. 3) including a paper feed motor 27 and a paper discharge motor 28, while the ink-jet head 3 is reciprocatively moved in the scanning direction together with the carriage 2. Accordingly, for example, the desired image and/or letters is/are recorded on the recording paper P.

The maintenance mechanism 7 is arranged in an area (maintenance position) disposed on the outer side (right side as shown in FIG. 1) as compared with the printing area opposed to the recording paper P, within the range of movement of the carriage 2 in relation to the scanning direction. The maintenance mechanism 7 has, for example, a cap member 13 which can be brought in tight contact with the liquid-jetting surface 3*a* of the ink-jet head 3 while surrounding the nozzles 3*b*, a suction pump 14 which is connected to the cap member 13, and a wiper 16 which wipes out the inks adhered to the liquid-jetting surface 3*a* of the ink-jet head 3.

When the carriage 2 is moved to the maintenance position in order to restore the liquid-jetting performance of the ink-jet head 3, the cap member 13 is opposed to the liquid jetting surface 3*a* of the ink-jet head 3. Further, the cap member 13 is driven upwardly (toward the front side of the paper surface in FIG. 1) by a cap driving device 25 (see FIG. 3), and the cap member 13 is brought in tight contact with the liquid-jetting surface 3*a* of the ink-jet head 3 so that the plurality of nozzles 3*b* are covered therewith at once.

The suction pump 14 is operated in the state in which the cap member 13 covers the nozzles 3*b* which are open on the liquid jetting surface 3*a* of the ink jet head 3. Accordingly, the so-called suction purge is performed, in which the inks are sucked and discharged from the nozzles 3*b*. The suction purge is performed in order that the inks in the nozzles 3*b*, which have the raised viscosity (subjected to the increase in viscosity) due to the vaporization of water, are discharged from the nozzles 3*b*, and the inks in the ink cartridges 6 are introduced into the subtanks 4 and the ink-jet head 3 when the ink cartridges 6 are exchanged. The suction purge is performed at every predetermined periods of time or when the power source of the printer 1 is turned ON, or the suction purge is performed when the ink cartridge 6 is exchanged. After the inks are sucked and discharged from the nozzles 3*b*, the cap member 13 is moved downwardly, and the cap member 13 is separated from the liquid-jetting surface 3*a* of the ink-jet head 3. In this state, the ink-jet head 3 is moved in the scanning direction with respect to the wiper 16 together with the carriage 2. Accordingly, the inks, which are adhered to the liquid-jetting surface 3*a* of the ink-jet head 3, are wiped out by the wiper 16.

Next, an explanation will be made with reference to FIG. 2 about an ink supply system ranging from the ink cartridges 6 to the ink-jet head 3. In this embodiment, the inks are supplied from the ink cartridges 6 to the ink-jet head 3. Therefore, the explanation will be made assuming that the ink cartridges 6 are disposed at the upstream end and the ink-jet head 3 is disposed at the downstream end. In this embodiment, the routes, in which the inks are supplied from the ink cartridges 6 to the ink-jet head 3, are present for the four color inks respectively. However, the routes are not constructed differently in relation to each of the four color inks. Therefore, the following description will be made as exemplified by the ink supply system for any one of the colors by way of example.

Figure 2:
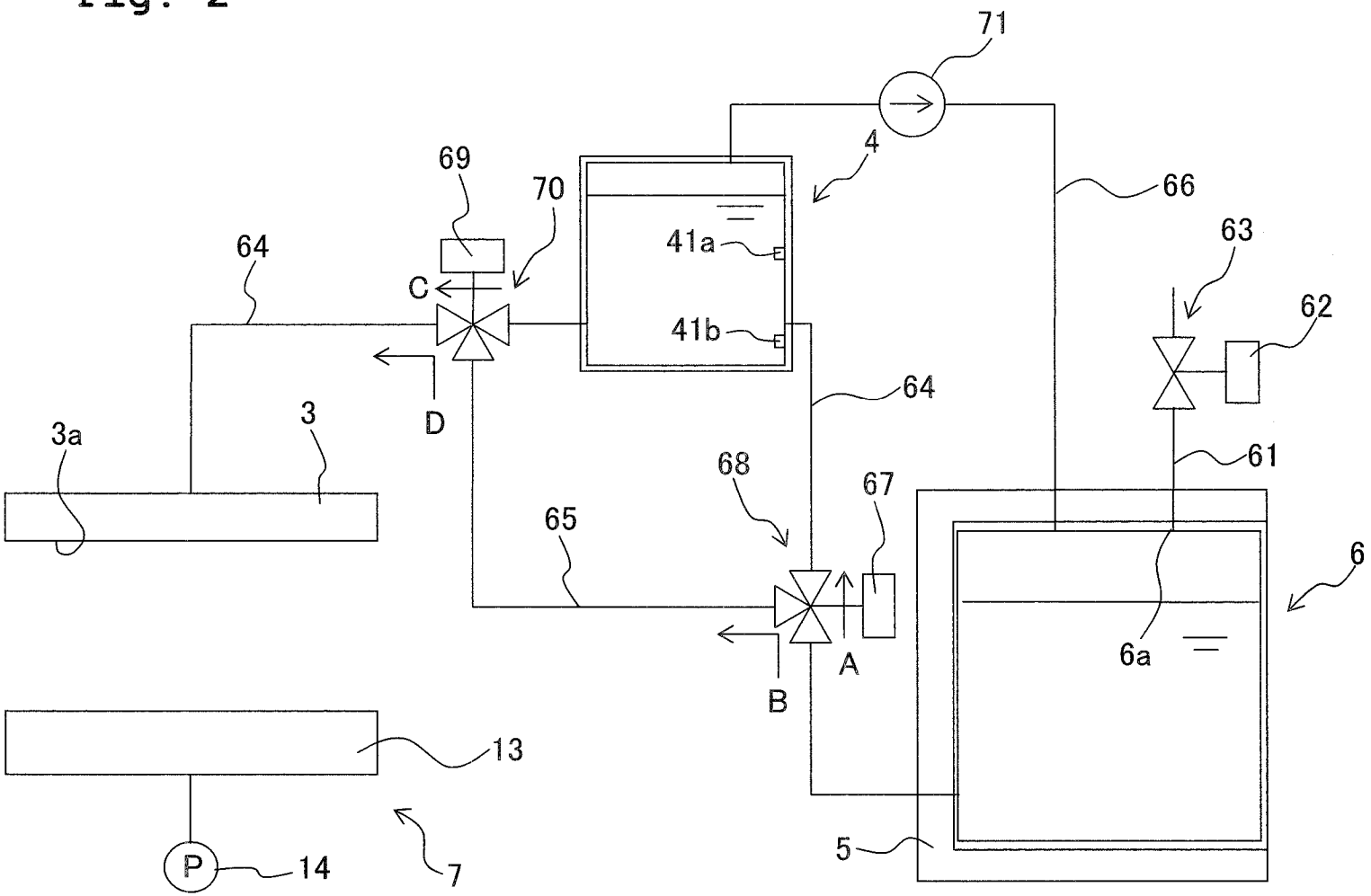
FIG. 2 shows a schematic arrangement of the printer.

As shown in FIG. 2, the ink cartridge 6 is connected to the ink-jet head 3 via a first flow passage 64 which includes the flow passage formed in the tube 11. The ink cartridge 6 is held at the position at which the height of the liquid surface of the stored ink is lower than the liquid-jetting surface 3*a* of the ink-jet head 3. Therefore, the negative pressure is provided in the nozzles on the liquid-jetting surface 3*a* of the ink-jet head 3. The subtank 4 is arranged at an intermediate position of the first flow passage 64. The upstream side and the downstream side of the first flow passage 64 with respect to the subtank 4 are connected by a second flow passage 65. The subtank 4 is connected to the ink cartridge 6 via a gas communication passage 66. The first flow passage 64 from which the flow passages formed in the tube 11 are excluded, the second flow passage 65, and the gas communication passage 66 are formed with unillustrated flow passage members and tubes. Portions thereof are fixed to the carriage 2.

An atmospheric air communication hole 6*a*, which is communicated with the atmospheric air, is formed through the ink cartridge 6. When the ink cartridge 6 is attached to the cartridge attachment section 5, the atmospheric air communication hole 6*a* is communicated with an atmospheric air communication tube 61 which is communicated with the atmospheric air. An opening/closing valve 63, which is driven by a cylinder 62, is arranged at an intermediate position of the atmospheric air communication tube 61. The cylinder 62 and the opening/closing valve 63 are fixed to the cartridge attachment section 5, and they are used commonly to the four ink cartridges 6. The ink cartridge 6, which is attached to the cartridge attachment section 5, is communicated with the atmospheric air via the atmospheric air communication hole 6*a* when the opening/closing valve 63 is open. When the opening/closing valve 63 is closed, the communication with the atmospheric air is shut off. The atmospheric air communication hole 6*a* may be indirectly opened/closed by opening/closing the atmospheric air communication tube 61 by the opening/closing valve 63. Alternatively, the atmospheric air communication hole 6*a* may be directly opened/closed by any opening/closing valve.

A three-way valve 68, which is driven by a cylinder 67, is arranged at a branch point (first branch point) branched to the second flow passage 65 between the ink cartridge 6 and the subtank 4 in the first flow passage 64. A three-way valve 70, which is driven by a cylinder 69, is arranged at a branch point (second branch point) merged with the second flow passage 65 between the subtank 4 and the ink-jet head 3 in the first flow passage 64. The cylinders 67, 69 and the three-way valves 68, 70 are fixed to the carriage 2, and they are used commonly to the ink flow passages for the respective color inks.

The three-way valve 68 is operated as follows. That is, the first flow passage 64, which is disposed between the ink cartridge 6 and the subtank 4, is subjected to the communication in accordance with the driving of the cylinder 67 so that the ink can be supplied in the direction of the arrow A. In another situation, the flow passage, which is branched from the first flow passage 64 to the second flow passage 65, is subjected to the communication so that the ink can be supplied in the direction of the arrow B.

The three-way valve 70 is operated as follows. That is, the first flow passage 64, which is disposed between the subtank 4 and the ink-jet head 3, is subjected to the communication in accordance with the driving of the cylinder 69 so that the ink can be supplied in the direction of the arrow C. In another situation, the flow passage, which is merged from the second flow passage 65 to the first flow passage 64, is subjected to the communication so that the ink can be supplied in the direction of the arrow D.

A one-way valve 71, which permits only the outflow of the gas from the subtank 4 to the ink cartridge 6 and which prevents the inflow of the gas from the ink cartridge 6 to the subtank 4, is arranged at an intermediate position of the gas communication passage 66.

In this embodiment, the first passage route is defined as the route in which the ink in the ink cartridge 6 is supplied to the ink-jet head 3 via the subtank 4 while allowing the ink to pass through only the first flow passage 64. The second passage route is defined as the route in which the ink in the ink cartridge 6 is supplied to the ink-jet head 3 without passing through the subtank 4 and the route is branched from the first flow passage 64 to allow the ink to pass through the second flow passage 65 and the route is merged with the first flow passage 64 again.

Two electrodes 41*a*, 41*b* are arranged on the side wall of the subtank 4 at positions having different heights respectively. The electrode 41*a* is arranged in the subtank 4 at the position higher than the supply hole for supplying the ink from the subtank 4 to the ink-jet head 3. The electrode 41*b* is arranged at the position lower than the electrode 41*a*.

When the voltage is applied between the two electrodes 41*a*, 41*b* provided for the subtank 4, then the two electrodes 41*a*, 41*b* are in conduction via the ink, and the resistance value between the two electrodes 41*a*, 41*b* is a low value, when the ink is stored to arrive at a position higher than the electrode 41*a* which is disposed at the higher position of those of the two electrodes 41*a*, 41*b*. On the other hand, when the ink is merely stored up to a position lower than the electrode 41*a*, then the two electrodes 41*a*, 41*b* are in the insulation state, and the resistance value between the two electrodes 41*a*, 41*b* is an extremely high value.

Therefore, it is assumed that the predetermined amount is an amount of the gas in the subtank 4 when the ink is stored in the subtank 4 until arrival at the height at which the electrode 41*a* is arranged. On this assumption, it is possible to detect whether or not the gas in the subtank 4 is in the predetermined amount by detecting the resistance value between the two electrodes 41*a*, 41*b*.

Figure 3:
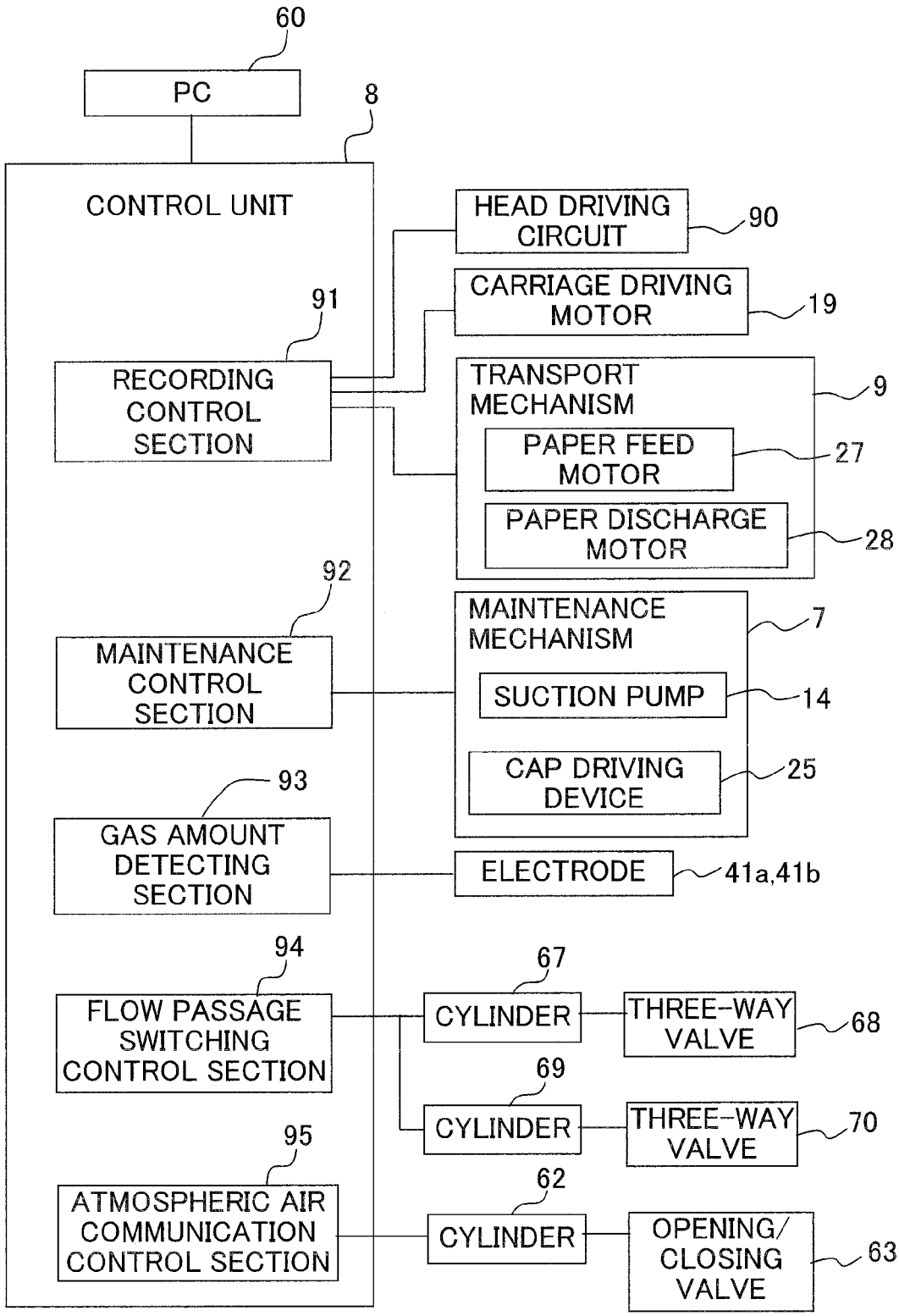
FIG. 3 shows a block diagram schematically illustrating an electrical arrangement or the printer.

Next, an explanation will be made with reference to a block diagram shown in FIG. 3 about the control system of the printer 1. The control unit 8 of the printer 1 includes, for example, CPU (Central Processing Unit) which is the central processing unit, ROM (Read Only Memory) in which, for example, various programs and data are stored to control the operation of the entire printer 1, and RAM (Random Access Memory) which temporarily stores, for example, data to be processed by CPU. When the programs stored in ROM are executed by CPU, various operations are performed as explained below. Alternatively, the control system may be those based on the hardware or the like as obtained by combining various circuits including the calculating or computing circuit.

The control unit 8 further includes a recording control section 91, a maintenance control section 92, a gas amount detecting section 93, a flow passage switching (changeover) control section 94, and an atmospheric air communication control section 95. The functions of the recording control section 91, the maintenance control section 92, the gas amount detecting section 93, the flow passage switching control section 94, and the atmospheric air communication control section 95 can be realized, for example, by CPU, RAM, and ROM described above.

The recording control section 91 controls, for example, a head driving circuit 90 (energy applying section) which applies the jetting energy to the ink in the ink-jet head 3, the carriage driving motor 19 which drives the carriage 2, and the paper feed motor 27 and the paper discharge motor 28 which are included in the transport mechanism 9 based on the data in relation to, for example, the recording image inputted from PC 60 to record, for example, a desired image on the recording paper P. The maintenance control section 92 controls the cap driving device 25 and the suction pump 14 which are included in the maintenance mechanism 7 to execute the suction purge for the ink-jet head 3.

The gas amount detecting section 93 judges whether or not the gas in each of the subtanks 4 is in not less than the predetermined amount based on the resistance value between the two electrodes 41*a*, 41*b* provided for each of the subtanks 4. The flow passage switching control section 94 controls the cylinders 67, 69 (switching mechanisms) to switch the three-way valves 68, 70 respectively into the state in which the ink can be supplied in the directions of the arrows A, C and the state in which the ink can be supplied in the directions of the arrows B, D. Accordingly, the flow passage switching control section 94 selectively switches the first passage route which supplies the ink from the ink cartridge 6 to the ink-jet head 3 via the subtank 4 and the second passage route which supplies the ink from the ink cartridge 6 to the ink-jet head 3 without passing through the subtank 4. The atmospheric air communication control section 95 controls the cylinder 62 to open the opening/closing valve 63 so that the interior of each of the ink cartridges 6 attached to the cartridge attachment section 5 is communicated with the atmospheric air thereby.

Figure 4:
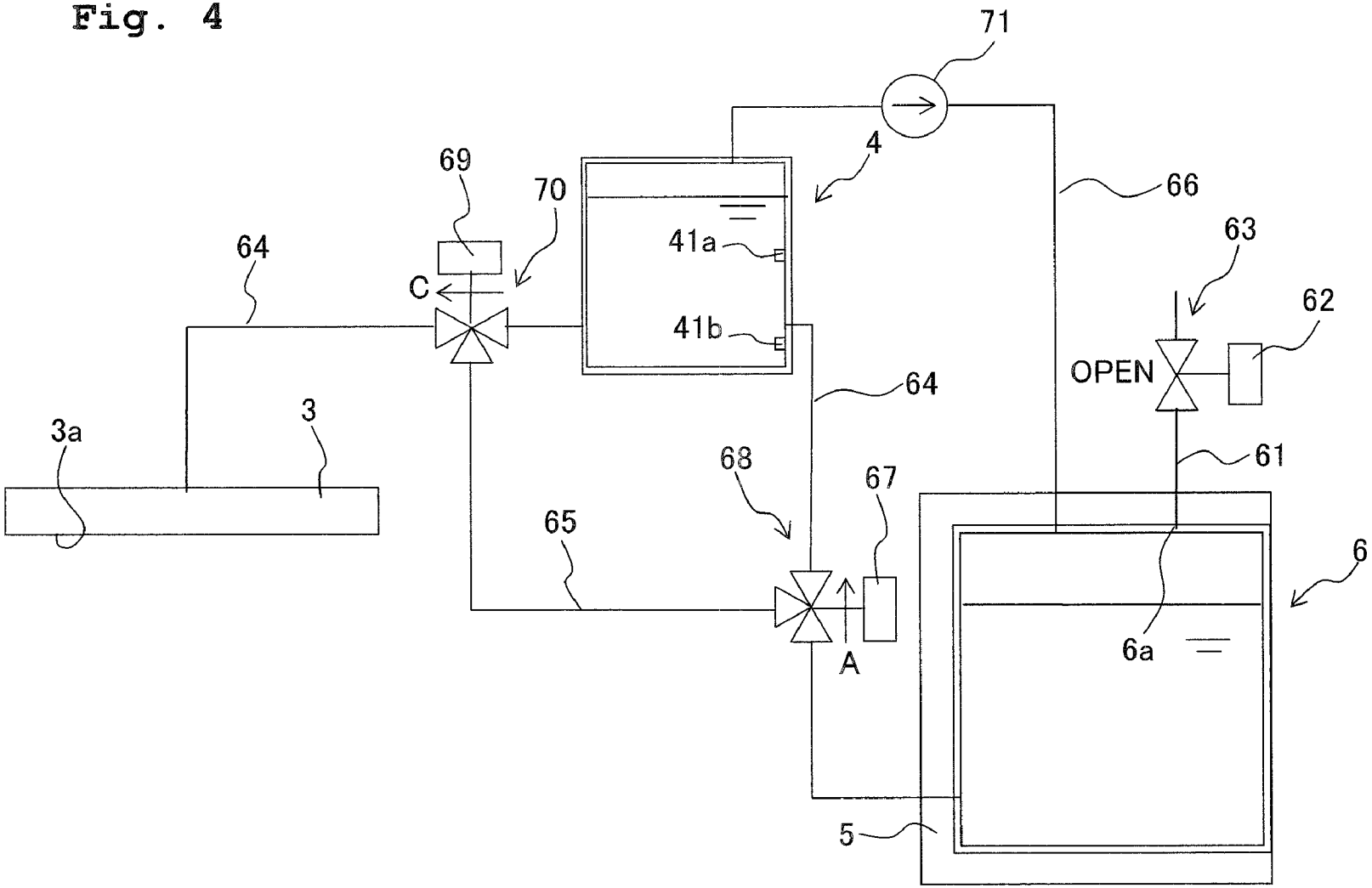
FIG. 4 shows a schematic arrangement of the printer when the recording operation is performed.

In the printer 1, if it is detected by the gas amount detecting section 93 that only the gas of less than the predetermined amount is stored in each of the subtanks 4, i.e., that a sufficient amount of the ink is stored, as shown in FIG. 4, the three-way valves 68, 70 are controlled by the flow passage switching control section 94 so that the first passage route, which passes through the subtank 4 in the route through which the ink flows from the ink cartridge 6 to the ink-jet head 3, is open. Further, the opening/closing valve 63 is opened by the atmospheric air communication control section 95 to provide the state in which the interior of each of the ink cartridges 6 is communicated with the atmospheric air. On this condition, the ink is consumed from the ink-jet head 3 by performing the recording operation by the ink-jet head 3 or by performing the suction purge by the maintenance mechanism 7.

In this situation, the inflow of the gas from the ink cartridge 6 into the subtank 4 is avoided, because the one-way valve 71 is provided for the gas communication passage 66 which communicates the subtank 4 and the ink cartridge 6. The ink is reliably derived from the ink cartridge 6 to the subtank 4 via the first flow passage 64.

As details will be described later on, the opening/closing valve 63 is open to communicate the interior of each of the ink cartridges 6 with the atmospheric air so that the ink is consumed from the ink-jet head 3 except for such a situation that the gas in the subtank 4 is transported to the ink cartridge 6. Accordingly, the ink can be supplied to the ink-jet head 3 without allowing the ink in the ink cartridge 6 to remain.

It is noted that the gas is sometimes mixed from the outside into the flow passage ranging from the ink cartridge 6 to the ink-jet head 3 due to various factors. The gas tends to be mixed from the joining portion of the cartridge attachment section 5 with respect to the ink cartridge 6 during the carriage exchange in which the empty ink cartridge 6 is detached from the cartridge attachment section 5 and a new ink cartridge 6 is attached. Further, the gas, which is dissolved in the ink, is converted into the bubbles in some cases due to the change of the temperature and/or the pressure. In general, the flow passage, which is formed in the ink-jet head 3, is constructed such that the flow passage is complicated as compared with the flow passage ranging from the ink cartridge 6 to the ink jet head 3, and the bubbles, which have been once mixed therein, are hardly moved. Therefore, if the gas, which is in the flow passage ranging from the ink cartridge 6 to the ink-jet head 3, flows to the ink-jet head 3 in accordance with the consumption of the ink from the ink-jet head 3, then the gas cannot be discharged by the jetting pressure of an extent brought about by the recording operation, and the gas causes, for example, the jetting failure and/or the flow passage clog-up.

In view of the above, in this embodiment, the gas mixed as described above is trapped by the subtank 4 so that the gas does not flow to the ink-jet head 3. Further, the gas amount in the subtank 4 is detected by detecting the resistance value between the two electrodes 41*a*, 41*b*. When the gas, which is in an amount of not less than the predetermined amount, stays in any one of the subtanks 4, the gas in each of the subtanks 4 is transported into the ink cartridge 6.

Figure 5:
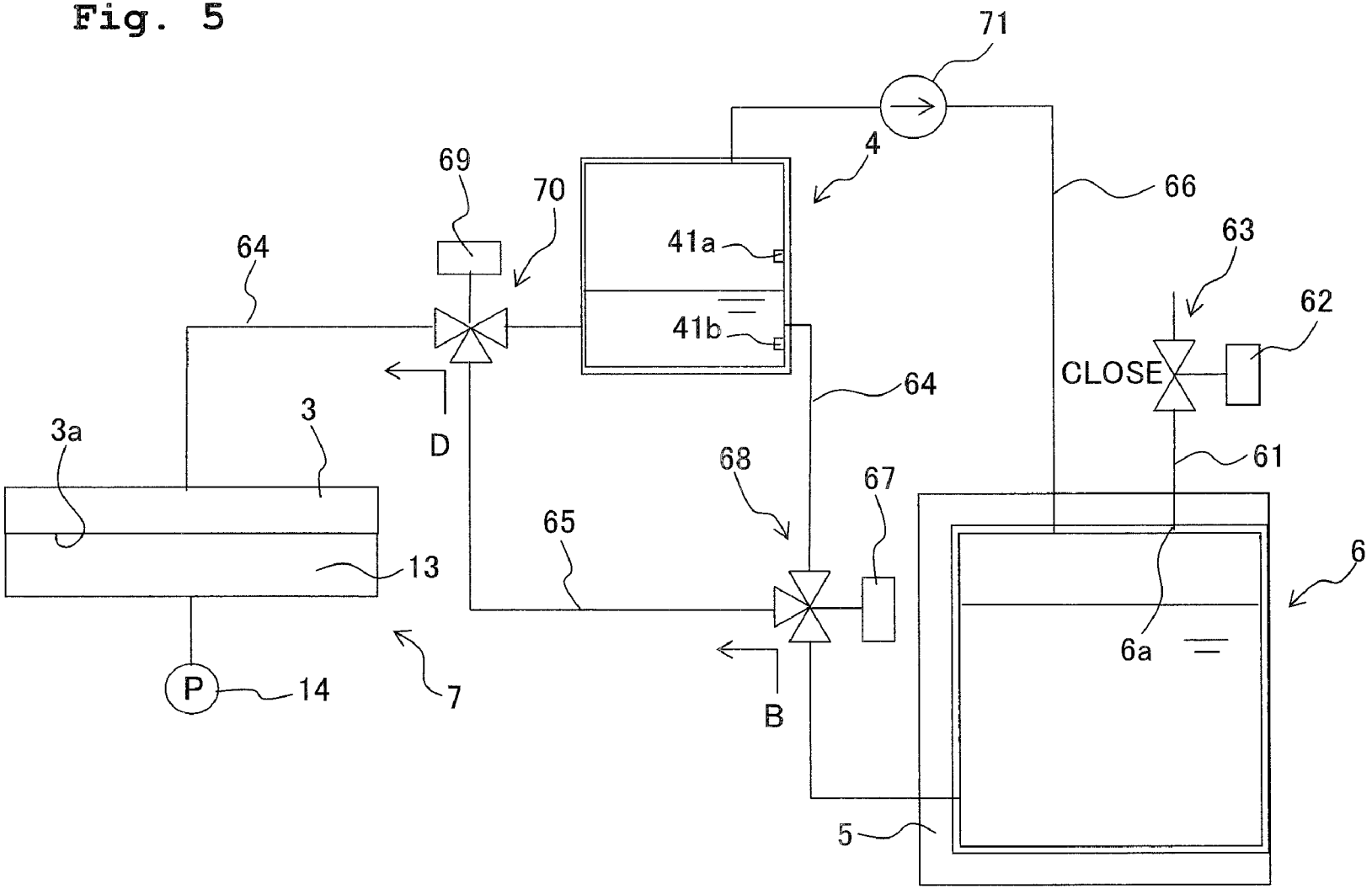
FIG. 5 shows a schematic arrangement of the printer when the suction purge is performed.

When the gas amount detecting section 93 detects that the gas in any one of the subtanks 4 is in an amount of not less than the predetermined amount, i.e., that the resistance value between the two electrodes 41*a*, 41*b* is an extremely large value, the following control is performed immediately before the next suction purge. At first, as shown in FIG. 5, the cylinders 67, 69 are controlled by the flow passage switching control section 94 to switch the three-way valves 68, 70 so that the second passage route, which does not pass through the subtank 4, is open (available) in the route ranging from the ink cartridge 6 to the ink-jet head 3 for allowing the ink to flow, and the opening/closing valve 63 is closed by the atmospheric air communication control section 95. The suction purge is performed by the maintenance mechanism 7.

Accordingly, the ink is discharged from the ink-jet head 3 in accordance with the suction purge. In this situation, the ink in the ink cartridge 6 is supplied to the ink-jet head 3 via the second passage route without passing through the subtank 4. The ink is supplied to the ink-jet head 3 and the ink is decreased, and thus the so-called negative pressure is provided in the ink cartridge 6 and the pressure is lower than the atmospheric pressure, because the opening/closing valve 63 is closed and the communication with the atmospheric air is shut off. Accordingly, the pressure difference arises between the ink cartridge 6 and the subtank 4 communicated with the ink cartridge 6. In this situation, the pressure in the ink cartridge 6 corresponding to each of the subtanks 4 is lower than the pressure in each of the subtanks 4. Therefore, the gas, which is in the subtank 4 having the high pressure, is transported into the ink cartridge 6 having the lower pressure via the gas communication passage 66 until the pressure difference disappears. In this way, in this embodiment, the gas in the subtank 4 is transported to the ink cartridge 6 when the purge is performed. Therefore, the gas does not flow into the ink flow passage in the ink-jet head 3, and the jetting failure and/or the flow passage clog-up is/are not caused thereby.

As described above, in this embodiment, the gas in each of the subtanks 4 is transported into the corresponding ink cartridge 6 when the purge is performed. Therefore, it is possible to avoid such a situation that the gas flows into the complicated ink flow passage in the ink-jet head 3 to cause the jetting failure and/or the flow passage clog-up. Further, the gas in the subtank 4 can be simultaneously transported into the ink cartridge 6 while performing the suction purge. Therefore, the ink is not discharged in order to merely discharge the gas in the subtank 4 to the outside of the subtank 4. It is possible to suppress any useless ink consumption. Further, no time is wasted in order to merely transport the gas in the subtank 4 to the ink cartridge 6 as well. Furthermore, when the gas in any one of the subtanks 4 is in an amount of not less than the predetermined amount, the gas in each of the subtanks 4 can be reliably transported to the corresponding ink cartridge 6.

A considerable amount of the ink is discharged from the ink-jet head 3 during the suction purge. Therefore, a greater part of the gas in the subtank 4 is transported into the ink cartridge 6. Therefore, when the suction purge is completed, the cylinders 67, 69 are controlled again by the flow passage switching control section 94 to switch the three-way valves 68, 70 so that the first passage route, which passes through the subtank 4, is available. The opening/closing valve 63 is opened by the atmospheric air communication control section 95 to provide the state in which the interior of the ink cartridge 6 is communicated with the atmospheric air. The ink is consumed from the ink-jet head 3 by performing the recording operation by the ink-jet head 3 or performing the suction purge by the maintenance mechanism 7.

The gas in each of the subtanks 4 may be transported to the corresponding ink cartridge 6 not merely simultaneously with the suction purge, but during the recording operation by switching the passage route from the first passage route to the second passage route and closing the opening/closing valve 63 immediately after it is detected that the gas in any one of the subtanks 4 is in not less than the predetermined amount. According to this procedure, the gas in the subtank 4 can be transported to the ink cartridge 6 while performing the recording operation. The ink is not jetted from the ink-jet head 6 in order to merely transport the gas in the subtank 4 to the ink cartridge 6. It is possible to suppress any useless ink consumption.

Figure 6:
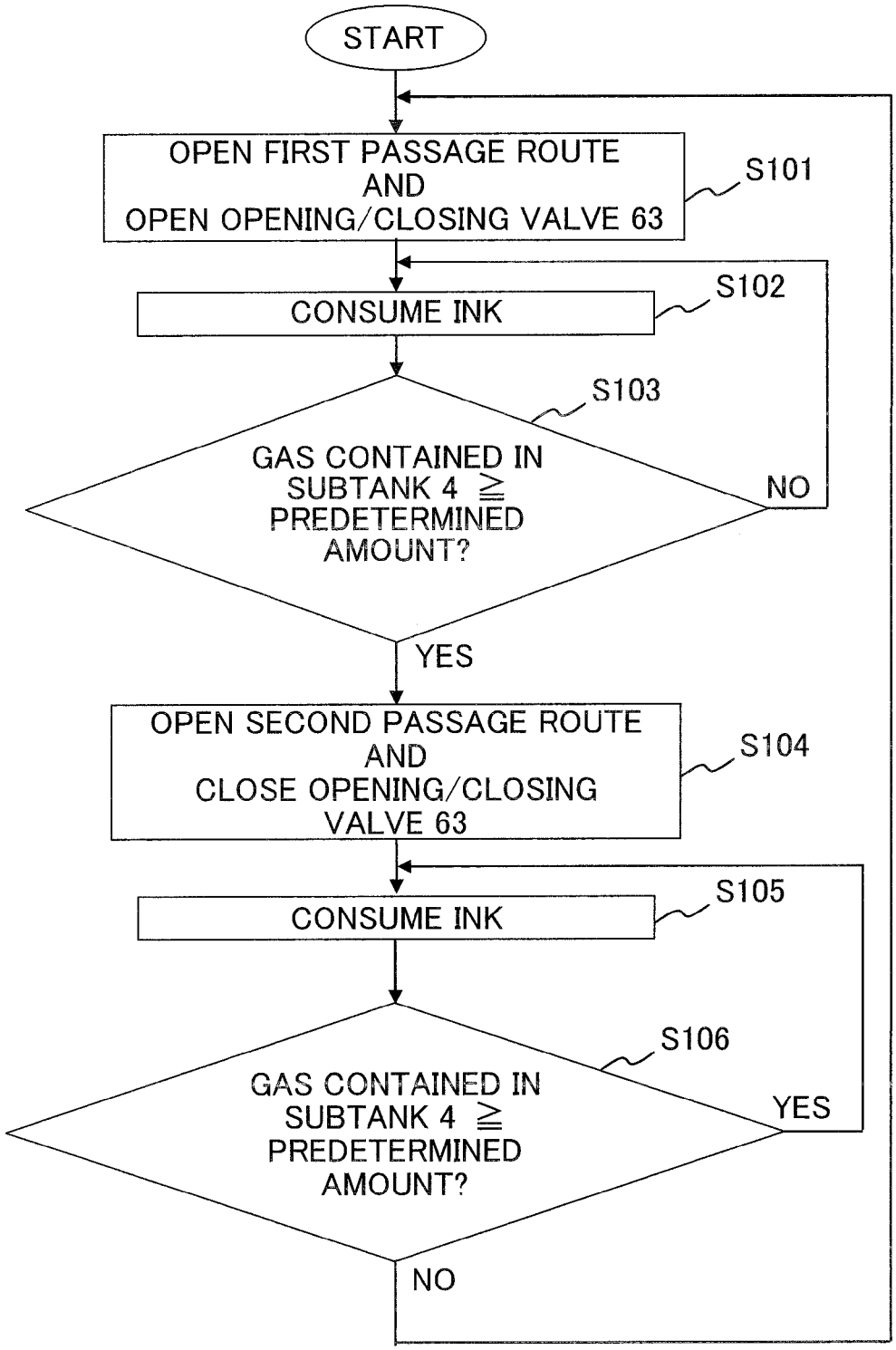
FIG. 6 shows a flow chart illustrating the control flow in the embodiment of the present invention.

The switching or changeover of the ink passage route, which is explained above in this embodiment, is performed in accordance with the flow shown in FIG. 6. That is, in the ordinary state in which the power source of the printer 1 is turned ON and the printing can be performed, the flow passage switching control section 94 controls the cylinders 67, 69 to switch to the first passage route with respect to the ink of each of the colors, and the atmospheric air communication control section 95 controls the cylinder 62 to open the opening/closing valve 63 (Step S101). In this state, the ink is consumed from the ink jet head 3 by the recording operation or the suction purge (Step S102). The ink is consumed from the ink-jet head 3 in the state in which first passage route is open and the opening/closing valve 63 is open during the period in which the gas amount detecting section 93 detects that the gas in each of the subtanks 4 is in less than the predetermined amount (Step S103: No). On the other hand, if the gas amount detecting section 93 detects that the gas in any one of the subtanks 4 is in not less than the predetermined amount (Step S103: Yes), then the flow passage switching control section 94 controls the cylinders 67, 69 to switch to the second passage route with respect to the ink of each of the colors, and the atmospheric air communication control section 95 controls the cylinder 62 to close the opening/closing valve 63 (Step S104). In this state, the ink is consumed from the ink-jet head 3 by the recording operation or the suction purge (Step S105). The ink is consumed from the ink-jet head 3 in the state in which the second passage route is open and the opening/closing valve 63 is closed during the period in which the gas amount detecting section 93 detects that the gas in any one of the subtanks 4 is in not less than the predetermined amount (Step S106: Yes). On the other hand, if the gas amount detecting section 93 detects that the gas in each of the subtanks 4 is in less than the predetermined amount (Step S106: No), then the flow passage switching control section 94 controls the cylinders 67, 69 to switch to the first passage route again with respect to the ink of each of the colors, and the atmospheric air communication control section 95 controls the cylinder 62 to open the opening/closing valve 63 again (Step S101).

As described above, according to this embodiment, it is appropriate that the passage route is merely switched from the first passage route to the second passage route while closing the opening/closing valve 63 when the operation such as the recording operation or the like, in which the ink is consumed from the ink-jet head 3, is performed, without being limited to the suction purge. In conformity with the operation as described above, the gas in each of the subtanks 4 can be transported to the corresponding ink cartridge 6. In other words, the operation for transporting the gas can be performed in combination with the operation for consuming the ink from the ink-jet head 3. Therefore, the ink is not consumed uselessly in order to merely transport the gas in the subtank 4 to the ink cartridge 6. Further, it is also unnecessary to waste any time for only the operation for transporting the gas in the subtank 4 to the ink cartridge 6. The operation for consuming the ink from the ink-jet head 3 also includes, for example, the flashing in which the ink is discharged from the ink-jet head 3 by controlling the head driving circuit 90 in order to restore the jetting performance of the ink jet head 3 in addition to the suction purge and the recording operation. Accordingly, it is unnecessary to add any driving means such as any exclusive pump or the like in order to transport the gas in the subtank 4 to the ink cartridge 6. It is possible to miniaturize the printer 1, and it is possible to reduce the electric power consumption as well.

The subtank 4, which absorbs the dynamic pressure generated in the ink in the tube 11 and which functions as the buffer tank for dissolving the supply shortage of the ink to be supplied to the ink-jet head 3, can be also used as the gas-liquid separating section for separating the gas and the liquid from each other so that the gas is not transported to the ink-jet head 3. It is possible to miniaturize the printer 1.

The following switching or changeover timing is available to stop the operation for transporting the gas in the subtank 4 to the ink cartridge 6. That is, an electrode is further provided at a position higher than the electrode 41*a* provided in the subtank 4 to measure the resistance value between the electrode 41*a* and the electrode provided at the position higher than the electrode 41*a*. If the resistance value is lowered, then it is judged that the gas is decreased to arrive at a position higher than the electrode provided at the highest position, and the switching may be performed. Alternatively, if the amount of ink consumption from the ink-jet head 3 is not less than a predetermined amount during the period in which the operation for transporting the gas is performed, then it is judged that the gas in the subtank 4 is sufficiently transported, and the switching may be performed. Further alternatively, a timer may be provided, and the switching may be performed when a predetermined period of time elapses after the start of the operation for transporting the gas in the subtank 4 to the ink cartridge 6.

However, if the operation for transporting the gas in the subtank 4 to the ink cartridge 6 is performed together with the recording operation, it is feared that the jetting characteristic may be unstable, for example, such that the ink jetting speed from the nozzles 3*b* may be changed, because the pressure differs in the ink cartridge 6 and/or in the flow passage through which the ink flows from the ink cartridge 6 to the ink jet head 3 between the situation in which the ink provided via the second passage route is jetted from the ink-jet head 3 and the situation in which the ink provided via the first passage route is jetted from the ink-jet head 3. Accordingly, the gas in the subtank 4 may be transported into the ink cartridge 6 during the suction purge not during the recording operation. Thus, the problem as described above does not arise during the recording operation, and it is possible to stabilize the jetting characteristic.

Next, an explanation will be made about modified embodiments in which various modifications are applied to the embodiment described above. However, the components or parts, which are constructed in the same manner as in the embodiment described above, are designated by the same reference numerals, any explanation of which will be appropriately omitted.

In the embodiment of the present invention, the cylinders 67, 69 and the three-way valves 68, 70 are used commonly for the ink flow passages for the inks of the respective colors, and the cylinder 62 and the opening/closing valve 63 are used commonly for the four ink cartridges 6, and the flow passages are uniformly switched thereby in relation to all of the ink colors. However, the way of switching the flow passage is not limited thereto. For example, the cylinders 67, 69 and the three-way valves 68, 70 may be provided for each of the ink flow passages for the respective colors, and the cylinder 62 and the opening/closing valve 63 may be provided distinctly for each of the four ink cartridges 6 so that the flow passage may be switched for each of the ink colors in the same manner as in the embodiment of the present invention.

In the embodiment of the present invention, the second flow passage 65 is branched from the upstream side of the first flow passage 64 as compared with the subtank 4, and the second flow passage 65 is merged with the downstream side of the first flow passage 64 as compared with the subtank 4. However, a flow passage, which is different from the first flow passage 64, may be provided without being branched from the first flow passage 64, and the ink cartridge 6 and the ink-jet head 3 may be directly connected to one another without passing through the subtank 4. As for the second flow passage 65, the ink cartridge 6 may be connected to the second branch point, or the first branch point may be connected to the ink-jet head 3.

In the embodiment of the present invention, the gas in the subtank 4 is transported to the ink cartridge 6 when it is detected by the gas amount detecting section 93 that the gas in the subtank 4 is in not less than the predetermined amount. However, when the carriage is exchanged, then the gas is easily mixed into the flow passage, and the gas tends to stay in the subtank 4. Accordingly, the passage route may be switched from the first passage route to the second passage route every time after the carriage is exchanged, without providing the gas amount detecting section 93, and the ink may be consumed from the ink-jet head 3. Accordingly, the gas in the subtank 4 may be transported to the ink cartridge 6. It is also allowable to judge whether or not the carriage is exchanged in accordance with the following arrangement. That is, electric contacts may be provided on the side of the cartridge attachment section 5 and the side of the ink cartridge 6 respectively. When the ink cartridge 6 is attached to the cartridge attachment section 5, a state, in which the both contacts are in conduction, may be detected. Accordingly, the attachment of the ink cartridge 6 may be detected thereby. Alternatively, it is also possible to use, for example, a proximity sensor, an optical sensor, or a contact type sensor. In this case, for example, a timer may be provided. When a predetermined period of time elapses after the point in time at which the carriage is exchanged, then the passage route may be switched from the second passage route to the first passage route, and the operation, in which the gas in the subtank 4 is transported to the ink cartridge 6, may be stopped.

In the embodiment of the present invention, the gas in the subtank 4 is transported to the ink cartridge 6 if it is detected by the gas amount detecting section 93 that the gas in the subtank 4 is in not less than the predetermined amount. However, the gas may be transported at any timing in accordance with a judgment by a user. In this case, it is unnecessary to control the flow passage switching timing and the atmospheric air communication timing for the interior of the ink cartridge 6 by the control unit 8. Or, a timer may be provided, and the flow passage switching control section 94 may switch to one of the first passage route and the second passage route alternately every time when detection is made with the timer that a predetermined period of time has elapsed.

Further, in the embodiment of the present invention, the one-way valve 71 is provided at the intermediate position of the gas communication passage 66 which communicates the ink cartridge 6 and the subtank 4. However, the valve may be an opening/closing valve without being limited to the one-way valve. In this arrangement, the following procedure is preferred. That is, the opening/closing valve is open only when the gas in the subtank 4 is transported to the ink cartridge 6. The opening/closing valve is closed in any other operation including, for example, the recording operation and the suction purge in which the ink is consumed from the ink-jet head 3. Accordingly, the ink can be reliably derived from the ink cartridge to the subtank 4.

Figure 7:
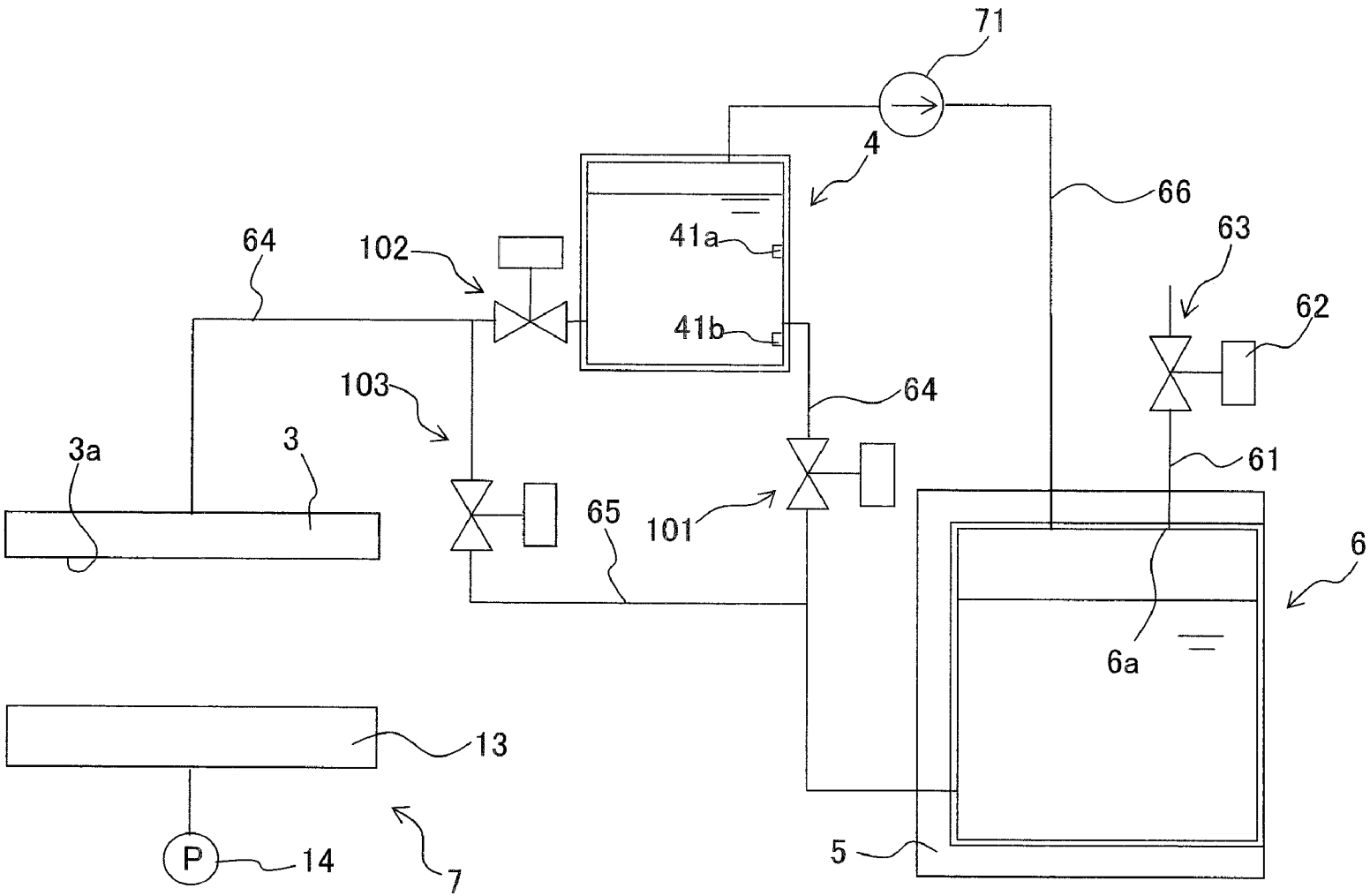
FIG. 7 shows a schematic arrangement of a printer according to a modified embodiment.

Additionally, in the embodiment of the present invention, the three-way valves 68, 70 are provided in order to switch the first passage route and the second passage route. However, as shown in FIG. 7, it is also appropriate to provide three opening/closing valves 101, 102, 103. When the first passage route is available, then the opening/closing valves 101, 102 may be open, and the opening/closing valve 103 may be closed. When the second passage route is available, then the opening/closing valves 101, 102 may be closed, and the opening/closing valve 103 may be open. In the embodiment of the present invention, the cylinders 67, 69 are controlled to switch the three-way valves 68, 69, and the cylinder 62 is controlled to open/close the opening/closing valve 63. However, the valve may be any valve for which the switching control can be performed. For example, it is also allowable to use a solenoid-operated valve.

In the embodiment of the present invention, the two electrodes 41*a*, 41*b* are provided in the subtank 4 to judge whether or not the gas in the subtank 4 is in not less than the predetermined amount. However, it is possible to judge whether or not the gas in the subtank 4 is in not less than the predetermined amount by appropriately using a known sensor for detecting the ink liquid surface.

In the embodiment of the present invention, if it is detected by the gas amount detecting section 93 that the gas in the subtank 4 is in not less than the predetermined amount, the flow passage switching control section 94 switches to the second passage route from the first passage route, and if it is detected by the gas amount detecting section 93 that the gas in the subtank 4 is in less than the predetermined amount, the flow passage switching control section 94 switches to the first passage route from the second passage route. However, the flow passage switching control section 94 may switch to the second passage route from the first passage route when it is detected by the gas amount detecting section 93 that the gas in the subtank 4 is not less than first predetermined amount, and may switch to the first passage route from the second passage route when it is detected by the gas amount detecting section 93 that the gas in the subtank 4 is less than second predetermined amount which is not greater than the first predetermined amount.

Further, in the embodiment of the present invention, the subtank 4 is also used as the gas-liquid separating section for separating the ink and the gas from each other. However, a gas-liquid separating section may be provided at an intermediate position of the flow passage for communicating the ink cartridge 6 and the ink-jet head 3, distinctly from the subtank 4.

Further, in the embodiment of the present invention, the suction purge is executed for the ink-jet head 3 by the suction pump 14. However, there is no limitation thereto. It is also possible to perform the so-called push purge in which the ink is discharged from the ink-jet head 3 by squeezing the tube 11 to raise the pressure of the ink in the tube 11.

Further, in the embodiment of the present invention, the ink cartridge 6 is formed with the atmospheric air communication hole 6*a* for making communication with the atmospheric air. However, there is no limitation thereto. It is also allowable that the atmospheric air communication hole 6*a* is not formed for the ink cartridge 6. In this case, the gas, which is transported from the subtank 4, can be discharged to the outside of the printer 1 by transporting the gas in the subtank 4 to the ink cartridge 6 and exchanging the ink cartridge 6. As for the concerning ink cartridge 6, when the ink is consumed from the ink-jet head 3 and the remaining amount of the ink is decreased, then the pressure is lowered in the ink cartridge 6. Therefore, the gas, which is dissolved in the ink, can be discharged to the outside from the ink. Accordingly, it is possible to further suppress the mixing or contamination with the gas in the ink-jet head 3.

Further, in the embodiment of the present invention, the ink cartridge 6 is constructed to be detachable with respect to the cartridge attachment section 5. However, there is no limitation thereto. The ink cartridge 6 may be fixed to the printer 1. Even in this case, the gas, which is transported from the interior of the subtank 4 to the ink cartridge 6, can be discharged to the outside of the printer 1 by opening the opening/closing valve 63 of the atmospheric air communication tube 61 which makes communication with the atmospheric air communication hole 6*a*.

The embodiment and the modified embodiments thereof explained above are exemplary applications of the present invention to the ink-jet printer for recording, for example, the image by jetting the inks to the recording paper P by way of example. However, the application objective of the present invention is not limited to the ink-jet printer as described above. The present invention is applicable to any liquid jetting apparatus usable in various technical fields.

What is claimed is:

1. A liquid-jetting apparatus which jets a liquid, the liquid-jetting apparatus comprising:

a liquid-jetting head which jets the liquid;

a liquid tank which stores the liquid to be supplied to the liquid-jetting head;

a first flow passage which connects the liquid-jetting head and the liquid tank;

a gas-liquid separating section which is arranged at an intermediate position of the first flow passage and which separates the liquid and a gas existing in the liquid from each other;

a gas communication passage which connects the gas-liquid separating section and the liquid tank and through which the gas in the gas-liquid separating section is transported to the liquid tank;

a valve which is arranged at an intermediate position of the gas communication passage and which avoids inflow of the gas from the liquid tank to the gas-liquid separating section;

a second flow passage which communicates an upstream side of the gas-liquid separating section and a downstream side of the gas-liquid separating section without passing through the gas-liquid separating section; and a switching mechanism which selectively switches between a first passage route for supplying the liquid in the liquid tank to the liquid-jetting head through only the first flow passage and a second passage route for supplying the liquid in the liquid tank to the liquid-jetting head through the second flow passage without passing through the gas-liquid separating section.

2. The liquid-jetting apparatus according to claim 1, wherein the second flow passage is a flow passage which communicates a first branch point provided between the liquid tank and the gas-liquid separating section in the first flow passage and a second branch point provided between the gas-liquid separating section and the liquid-jetting head in the first flow passage, without passing through the gas-liquid separating section.

3. The liquid-jetting apparatus according to claim 1, further comprising a controller which controls the switching mechanism, wherein the controller controls the switching mechanism to switch to the second passage route, and the gas in the gas-liquid separating section is transported via the gas communication passage to the liquid tank by consuming the liquid from the liquid-jetting head.

4. The liquid-jetting apparatus according to claim 3, further comprising a timer, wherein the controller controls the switching mechanism to switch to one of the first passage route and the second passage route alternately every time when detection is made with the timer that a predetermined period of time has elapsed.

5. The liquid-jetting apparatus according to claim 3, further comprising a gas amount detecting section which detects an amount of the gas in the gas-liquid separating section, wherein the controller controls the switching mechanism to switch to the second passage route when the amount of the gas detected by the gas amount detecting section is not less than a first predetermined amount.

6. The liquid-jetting apparatus according to claim 5, wherein the controller controls the switching mechanism so that the second passage route is switched to the first passage route when the amount of the gas detected by the gas amount detecting section is less than a second predetermined amount.

7. The liquid-jetting apparatus according to claim 6, wherein the second predetermined amount is not more than the first predetermined amount.

8. The liquid-jetting apparatus according to claim 3, further comprising an energy applying section which applies jetting energy to the liquid in the liquid-jetting head, wherein the controller controls the energy applying section; and the controller controls the switching mechanism to switch to the second passage route, and controls the energy applying section to jet the liquid from the liquid-jetting head.

9. The liquid-jetting apparatus according to claim 3, wherein the liquid-jetting head has a nozzle which jets the liquid;

the apparatus further includes a maintenance mechanism by which the liquid in the liquid-jetting head is discharged from the nozzle;

the controller controls the maintenance mechanism; and the controller controls the switching mechanism to switch to the second passage route, and controls the maintenance mechanism so that the liquid is discharged from the nozzle.

10. The liquid-jetting apparatus according to claim 3, wherein the liquid tank has an air communication hole through which inside of the liquid tank communicates with atmospheric air and an opening/closing valve which is controlled by the controller and which opens/closes the air communication hole; and the controller opens the opening/closing valve when the controller controls the switching mechanism to switch to the first passage route.

11. The liquid-jetting apparatus according to claim 1, further comprising an attachment section to which the liquid tank is detachably attached.

12. The liquid-jetting apparatus according to claim 11, further comprising:

a timer; and a controller which controls the switching mechanism, wherein the controller controls the switching mechanism to switch to the second passage route when the liquid tank is attached to the attachment section, and the controller controls the switching mechanism so that the second passage route is switched to the first passage route when detection is made with the timer that a predetermined period of time elapses after attaching the liquid tank to the attachment section.

13. The liquid-jetting apparatus according to claim 1, wherein the gas-liquid separating section is a subtank which temporarily stores the liquid to be supplied from the liquid tank to the liquid-jetting head.

* * * * *